US006411788B1

(12) United States Patent
Ogasawara

(10) Patent No.: US 6,411,788 B1
(45) Date of Patent: Jun. 25, 2002

(54) IMAGE FORMING APPARATUS WITH AIR FLOW REGULATOR

(75) Inventor: Masato Ogasawara, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/722,704

(22) Filed: Nov. 28, 2000

(51) Int. Cl.[7] ..... G03G 21/20; G03G 21/00; G03G 15/00

(52) U.S. Cl. ..... 399/92; 399/98; 399/397

(58) Field of Search ..... 399/91, 92, 98, 399/101, 102, 103, 310, 311, 315, 397; 250/324; 361/225

(56) References Cited

U.S. PATENT DOCUMENTS 4,080,053 A * 3/1978 Friday ..... 399/92 X
4,564,283 A * 1/1986 Fox et al. ..... 399/102
4,922,303 A * 5/1990 Takeda et al. ..... 399/92
5,132,731 A * 7/1992 Oda ..... 399/92
5,291,247 A * 3/1994 DeCecca ..... 399/92
5,983,053 A * 11/1999 Mordenga et al. ..... 399/103
6,282,402 B1 * 8/2001 Hayashida ..... 399/315 X

FOREIGN PATENT DOCUMENTS

JP 1-28513 8/1989

* cited by examiner

*Primary Examiner*—Sandra Brase
(74) *Attorney, Agent, or Firm*—Foley & Lardner

(57) ABSTRACT

The image forming apparatus of the present invention comprises a photosensitive drum, a developing roller, a transfer charger, a separation charger, a fixing device, a cleaning blade, and a fan. The developing roller contacting the outer peripheral surface of the drum is rotated to supply toner onto a latent image formed on the same surface of the drum, thereby developing the latent image. The toner image is transferred onto a transfer material that is being fed in a vertical direction. At this time, air is sucked by a fan arranged at the back side of the two chargers to form airflow advancing from the drum to the two chargers. Thus, the transfer material is adsorbed on the two chargers to stabilize feed pose of the transfer material. At this time, the airflow formed in the apparatus is partially regulated, particularly near both ends of the developing roller, to decrease the amount of the toner scattered inside the apparatus and reduce the amount of the toner discharged out of the apparatus.

24 Claims, 5 Drawing Sheets

IMAGE FORMING APPARATUS WITH AIR FLOW REGULATOR

BACKGROUND OF THE INVENTION

The present invention relates to an image forming apparatus such as a copying apparatus or a printer, and particularly to an image forming apparatus of a vertical feed type, wherein a sheet is fed in a vertical direction to pass the sheet through a transfer area.

Recently, as an image forming apparatus, a multiple apparatus (referred to as an MPF hereinafter) having functions as a copying apparatus, a facsimile, a printer and so on has been spreading.

As this MPF, there is known an in-body paper discharging type, wherein a sheet on which an image is formed is discharged inside the present apparatus in order to make the size of the apparatus small. In this in-body paper discharging type MPF, it is necessary to keep, inside the apparatus, a space for discharging sheets. Therefore, the sheets are fed in the vertical direction thereof to pass the sheets through the transfer area of the apparatus.

When in such vertical feed type MPFs a sheet that has passed through the transfer area is separated from its photosensitive drum, it is impossible that the sheet is laid down on a separation charger by gravity as in a conventional horizontal type. Therefore, there is a possibility that the feed pose of the sheet that has passed through the transfer area becomes instable so that inconveniences such as jamming are caused. For this reason, in conventional vertical feed type MPFs, air is sucked from the back side of their transfer charger and their separation charger to cause flow of the air near their transfer area, thereby adhering a sheet passing through the transfer area closely to the transfer charger and the separation charger. Thus, the feed pose of the sheet is made stable.

However, if airflow is caused inside an MPF as described above, toner that has leaked undesirably from its developing device and its cleaning device scatters inside the MPF. As a result, the following problems arise: its transfer charger and separation charger are polluted with the toner and the toner is discharged out of the apparatus. Particularly in both ends of the developing roller or both ends of the cleaning blade, from the viewpoint of structures thereof it is difficult that toner is completely sealed. Therefore, the amount of the toner leaking from these portions by the airflow caused in the apparatus increases undesirably, causing a problem that a great deal of the toner scatters inside the apparatus.

As a result, the toner adheres to the inside of the case of the transfer charger or the separation charger so that the electrical resistance of the portion to which the toner adheres increases. The amount of the electrical current flowing in the photosensitive drum increases accordingly. Alternatively, leakage is caused at the portion of the case to which no toner adheres. Such problems arise. When the amount of the electrical current flowing in the photosensitive drum increases, excessive transfer or excessive separation is caused to generate image failures such as a pockmark. When the leakage is caused inside the case of the transfer charger or the separation charger, the MPF may operate erroneously.

BRIEF SUMMARY OF THE INVENTION

In light of the above-mentioned situations, an object of the present invention is to provide an image forming apparatus making it possible to stabilize the feed pose of a transferring material and suppress the amount of a scattered developer in the apparatus.

To attain the above-mentioned object, the image forming apparatus of the present invention comprises: a developing device for supplying a developer to a latent image formed onto an image carrying body to develop the latent image; a feeding device for feeding a transfer material, using a feed path extending along the image carrying body; a transferring device for transferring the developer image developed by the developing device onto the transfer material fed using the feed path; an airflow forming device for forming flow of air for stabilizing feed pose of the transfer material that has passed through a transfer area between the transferring device and the image carrying body; and a regulating member for regulating a part of the airflow formed by the airflow forming device.

The image forming apparatus of the present invention comprises: a developing device comprising a developing roller that can contact an image carrying body, for causing the developing roller to be rotated so as to supply a developer to a latent image formed onto the image carrying body, thereby developing the latent image; a feeding device for feeding a transfer material, using a feed path extending along the image carrying body; a transferring device for transferring the developer image developed by the developing device onto the transfer material fed using the feed path; a separation device for separating, from the image carrying body, the transfer material on which the developed image is transferred by the transferring device; an airflow forming device for sucking air from the side, opposite to the image carrying body, of the feed path to form flow of air advancing from the image carrying body to the transferring device and the separation device, to adsorb the transfer material passing through a transfer area between the transferring device and the image carrying body, thereby stabilizing feed pose of the transfer material; a cleaning device for cleaning the developer remaining on the image carrying body without being transferred by the transferring device; and a regulating member for regulating a part of the airflow formed by the airflow forming device.

The image forming process of the present invention comprises the steps of: rotating a developing roller that contacts an image carrying body to supply a developer to a latent image formed onto the image carrying body, thereby developing the latent image; feeding a transfer material to the developer image developed on the image carrying body; transferring the developer image onto the fed transfer material; forming flow of air for stabilizing feed pose of the transfer material on which the developer image is transferred; and regulating a part of the airflow to reduce a scattered amount of the developer.

The image forming process of the present invention comprises the steps of: rotating a developing roller that contacts an image carrying body to supply a developer to a latent image formed onto the image carrying body, thereby developing the latent image; feeding a transfer material to the developer image developed on the image carrying body; transferring the developer image onto the fed transfer material; forming flow of air for stabilizing feed pose of the transfer material on which the developer image is transferred; and regulating a part of air passing through the vicinity of both ends in the axial direction of the developing roller, among the above-mentioned airflow, to reduce a scattered amount of the developer.

DETAILED DESCRIPTION OF THE INVENTION

Figure 1:
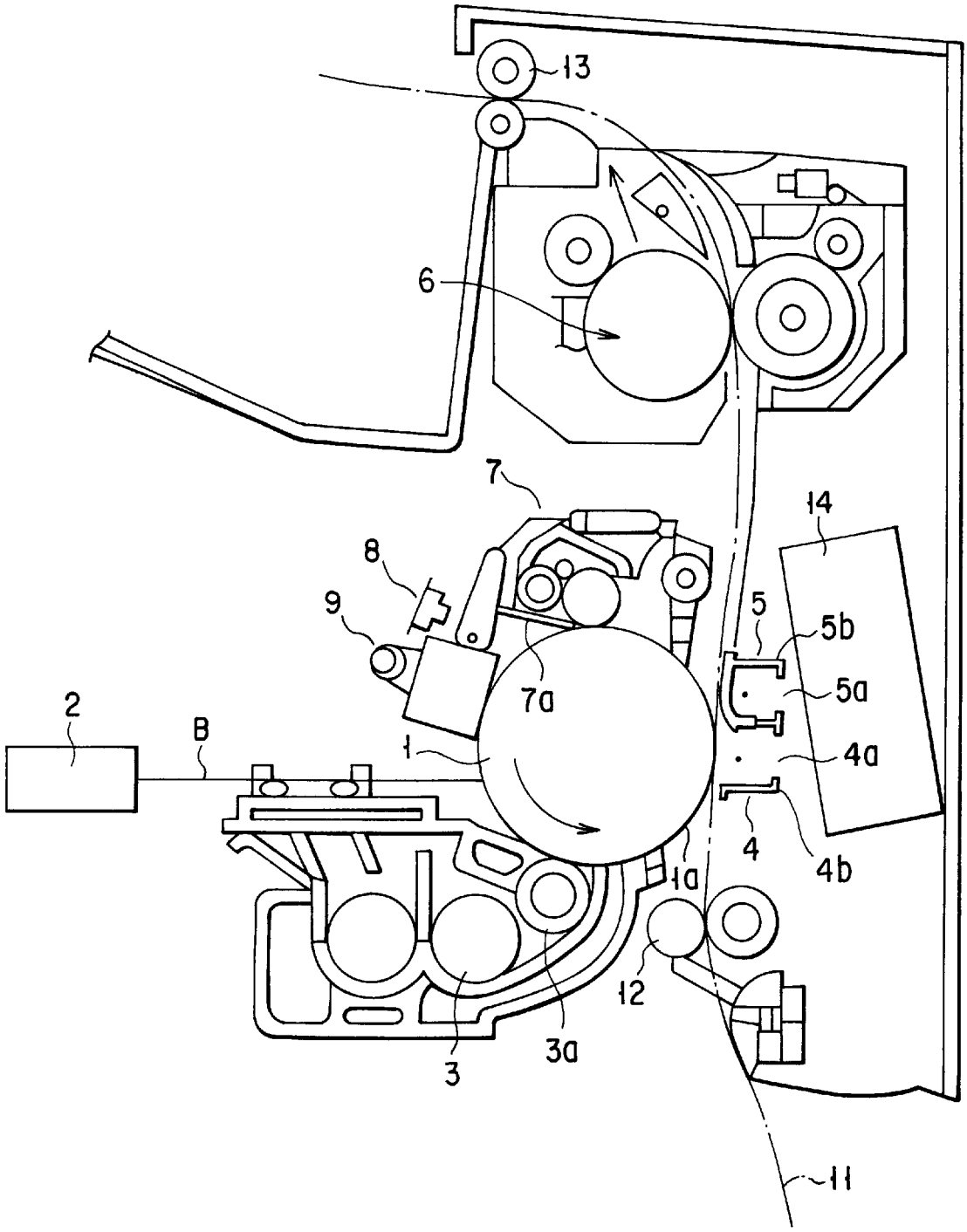
FIG. 1 is a schematic view illustrating main elements of an image forming apparatus according to an embodiment of the present invention.

Referring to the drawings, embodiments of the present invention will be in detail described hereinafter.

FIG. 1 is a schematic view illustrating main elements of a multiple apparatus (image forming apparatus) having functions as a copying apparatus, a facsimile, a printer and so on (hereinafter referred to as an MPF). This MPF is an in-body paper discharging type apparatus, wherein a sheet on which an image is formed is discharged inside the apparatus to make the size of the apparatus small. This MPF is also a vertical feed type apparatus, wherein a sheet is fed in the vertical direction thereof to pass the sheet through its transfer area in order to keep a space for discharging the sheet inside the apparatus.

The MPF comprises a non-illustrated scanner for reading an image from a non-illustrated document and then generating an image signal; an exposure device 2 for radiating a laser beam B based on the image signal supplied from the scanner or a non-illustrated external device onto an outer peripheral surface 1*a* of a photosensitive drum (image supporting body) 1; a developing device 3 for supplying toner (developer) to an electrostatic latent image formed on the outer peripheral surface 1*a* by the radiation of the laser beam from the exposure device 2, and developing the latent image; a transfer charger (transfer device) 4 for transferring the toner image developed on the outer peripheral surface 1*a* onto a sheet (transferring material); a separation charger (separation device) 5 for separating the sheet on which the toner image is transferred from the outer peripheral surface 1*a;* a fixing device 6 for heating and pressing the toner image adhering electrostatically to the separated sheet to fix the image onto the sheet; a cleaning device 7 for cleaning the toner remaining on the outer peripheral surface 1*a* of the photosensitive drum 1 without being transferred onto the sheet; an electrically discharging lamp 8 for removing charges remaining on the outer peripheral surface 1*a;* and an electrical charger 9 for making the outer peripheral surface 1*a* charged at a given level for the next image forming action.

Inside the MPF, a feed path 11 for feeding a sheet along the outer peripheral surface 1*a* of the photosensitive drum 1 is extended. This feed path 11 is extended in a substantially vertical direction and is passed through a transfer area between the outer peripheral surface 1*a* of the drum 1 and the transfer charger 4. The sheet is taken out from a non-illustrated sheet cassette, and is then supplied from the lower side in FIG. 1 onto the feed path 11. The sheet is once set in position by an aligning roller 12 set on the feed path 11. Thereafter, the sheet is fed toward the upper side in FIG. 1 along the feed path 11. The sheet fed to the upper side along the feed path 11 is passed through the transfer area and is then passed through the fixing device 6.

Thus, the electrostatic latent image formed on the outer peripheral surface 1*a* of the photosensitive drum 1 by the exposure device 2 is passed through the developing device 3 by rotation of the photosensitive drum 1, and is developed with toner supplied through the developing device 3. The developing device 3 has a developing roller 3*a* extended in parallel to the photosensitive drum 1. This developing roller 3*a* is rotated to supply toner kept on its outer peripheral surface onto the outer peripheral surface 1*a* of the photosensitive drum 1. In this way, the electrostatic latent image is developed.

The toner image developed on the outer peripheral surface 1*a* of the photosensitive drum 1 is passed through the transfer area by rotation of the photosensitive drum 1. At this time, the aligning roller 12 is rotated at a given timing so that a sheet is fed to the transfer area. By the transfer charger 4, the toner image on the outer peripheral surface 1*a* of the photosensitive drum 1 is electrostatically transferred onto the sheet.

The sheet, on which the toner image is transferred, passed through the transfer area is separated from the outer peripheral surface 1*a* of the photosensitive drum 1 by the separation charger 5. The sheet is fed to the upper side in FIG. 1 along the feed path 11 to be sent into the fixing device 6. The sheet on which the toner image is fixed through the fixing device 6 is discharged through a feed roller 13.

On the other hand, the toner remaining on the outer peripheral surface 1*a* of the photosensitive drum 1 without being transferred onto the sheet is scratched off by the cleaning blade 7*a* of the cleaning device 7 to be recovered. The cleaning blade 7*a* is formed into a rectangular plate form extending in the axial direction of the photosensitive drum 1. The blade 7*a* is arranged in the manner that its one end side contacts the outer peripheral surface 1*a* of the photosensitive drum 1 at a given angle.

Incidentally, when the sheet that has passed through the transfer area is separated from the outer peripheral surface 1*a* of the photosensitive drum 1 by the separation charger 5 in such a vertical feed type MPF as in the present embodiment, it is impossible that the sheet is laid down on the separation charger by gravity and fed as in any horizontal feed type apparatus. Thus, the feed pose of the sheet becomes unstable. When the feed pose of the sheet is unstable, the tip of the sheet may be bent on the feed path 11 going to the fixing device 6 so that jamming may be caused.

For this reason, in such a vertical feed type MPF as in the present embodiment, air is sucked from the back side, which is away from the photosensitive drum 1, of the transfer charger 4 and the separation charger 5, so as to make flow of the air inside the MPF. In this way, the sheet is fed in the state that the sheet is adsorbed on the transfer charger 4 and the separation charger 5 to make the feed pose of the sheet passing through the transfer area stable.

In other words, the transfer charger 4 and the separation charger 5 have cases 4*b* and 5*b,* respectively, in substantially rectangular box form. Each of the cases 4*b* and 5*b* has an opening in its portion opposite to the feed path 11. At the bottom side, which is away from the feed path 11, of the case 4*b* or 5*b* of the chargers 4 or 5, a slender slit (regulating member) 4*a* or 5*a* extending in the axial direction of the photosensitive drum 1 is made.

In the embodiment, as an airflow forming device for making airflow as described above inside the MPF, a fan 14 is arranged at the back side of the transfer charger 4 and the separation charger 5. In the fan 14, non-illustrated four fan-pieces are rotated to make airflow. The airflow based on the fan 14 passes through the slit 4*a* of the transfer charger 4 and the slit 5*a* of the separation charger 5 to generate negative pressure at the openings, at the side of the feed path 11, in the transfer charger 4 and the separation charger 5. By this negative pressure, the sheet fed along the feed path 11 is adsorbed in the openings in the transfer charger 4 and the separation charger 5 so that the feed pose of the sheet is made stable.

However, the airflow based on the fan 14 continues to flow inside the apparatus even when no sheet is fed. Therefore, toner leaking undesirably from the developing device 3 or the cleaning device 7 gets on the airflow and scatters inside the apparatus. Thus, the transfer charger 4 or the separation charger 5, which is present in the path where the air passes, is polluted. Particularly near both ends in the axial direction of the developing roller 3*a* in the developing device 3 or near both ends in the axial direction of the cleaning blade 7*a* in the cleaning device 7, from viewpoint of the structure thereof it is difficult that the toner is completely sealed. It is known that the amount of the toner leaking from the vicinity of both ends is relatively large. For example, the toner leaks from both ends of the developing roller 3*a* in an amount about nine times as much as the toner leaking from center part of the roller 3*a*. Therefore, particularly when airflow passes through the vicinity of both ends of the developing roller 3*a*, the toner leaks out, in an amount that is larger than in ordinary cases, from the vicinity of both ends of the developing roller 3*a* by this airflow.

In the present invention, therefore, airflow as described above is made inside the apparatus in order to make the feed pose of the sheet stable, and further a part of the airflow is regulated to reduce the amount of the toner leaking and scattering undesirably inside the apparatus. That is, by regulating the amount of the air flowing near both ends in the axial direction of the developing roller 3*a* and/or the cleaning blade 7*a*, the amount of the toner scattering inside the apparatus is reduced as much as possible. The following will describe several embodiments of the member for regulating airflow near both ends in the axial direction (regulating member).

Figure 2:
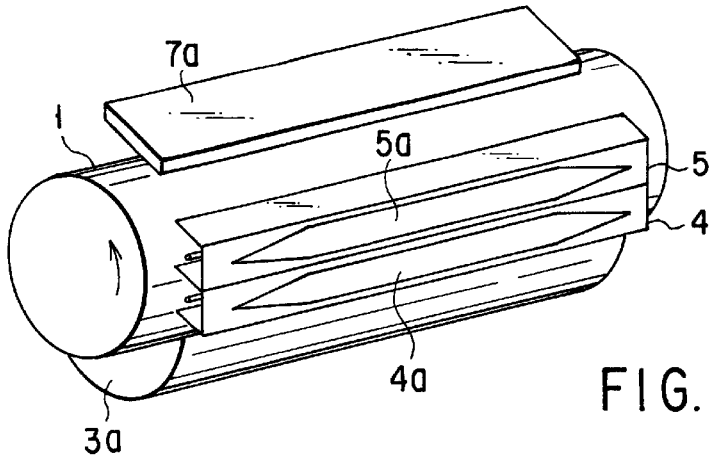
FIG. 2 is a perspective view illustrating the structure of a first embodiment of the present invention.

FIG. 2 illustrates a first embodiment. In this embodiment, about each of a slit 4*a* made in the bottom of a case 4*b* of a transfer charger 4 and a slit 5*a* made in the bottom of a case 5*b* of a separation charger 5 both ends in its axial direction are tapered toward the tips thereof. That is, the width of each of the slits 4*a* and 5*a* is made smaller toward its both ends. In this way, the opened area near both ends of each of the slits 4*a* and 5*a* can be made smaller than the center thereof so that the amount of air flowing through the vicinity of both ends of each of the slits 4*a* and 5*a* can be made smaller than that of air flowing through the vicinity of the center thereof. As a result, the amount of air flowing through the vicinity of both ends of the developing roller 3*a* and the cleaning blade 7*a* can be made far smaller than the amount of airflow in the center, so that the feed pose of a sheet can be made stable and the amount of toner scattering inside the apparatus and the amount of toner discharged out of the apparatus can be made very small.

Figure 3:
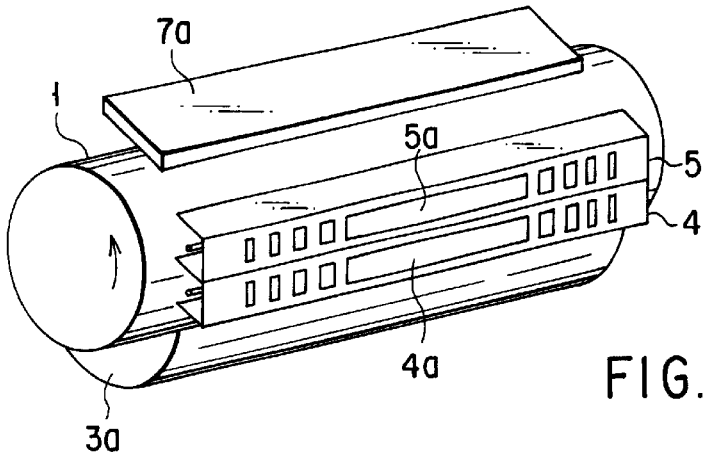
FIG. 3 is a perspective view illustrating the structure of a second embodiment of the present invention.

FIG. 3 illustrates a second embodiment. In this embodiment, rectangular openings having different opened areas are arranged in the longitudinal direction of the present device in such a manner that the opened a slit 5*a* in a separation charger 5 becomes smaller toward both ends in the axial direction thereof. That is, the openings are made in the manner that the opened areas gradually become smaller toward both ends in the longitudinal direction of each of the chargers 4 and 5. In this way, the amount of air flowing through the vicinity of both ends of each of the slits 4 and 5 can be made far smaller than the amount of airflow in the center thereof, so that the amount of air flowing through the vicinity of both ends of developing roller 3*a* and the cleaning blade 7*a* can be made far smaller than the amount of airflow in the center thereof.

Figure 4:
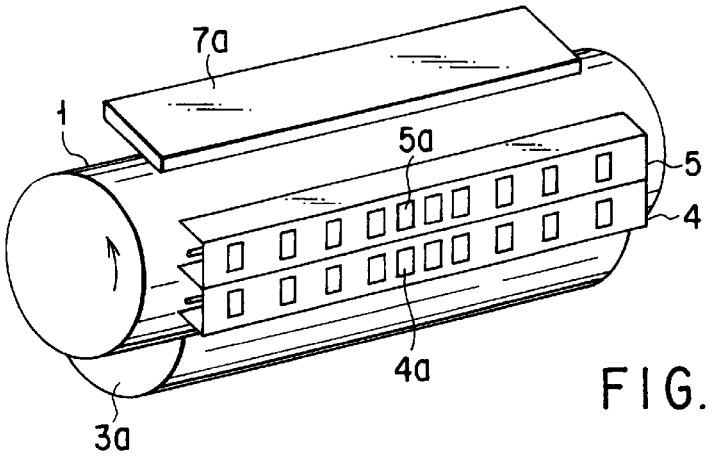
FIG. 4 is a perspective view illustrating the structure of a third embodiment of the present invention.

FIG. 4 illustrates a third embodiment. In this embodiment, rectangular openings having the same opened area are arranged in the longitudinal direction of the present device in such a manner that the opened area of each of a slit 4*a* in a transfer charger 4 and a slit 5*a* in a separation charger 5 becomes smaller toward both ends in the axial direction thereof. That is, the openings are made in the manner that the interval between the adjacent openings gradually becomes larger toward both ends in the longitudinal direction of each of the chargers 4 and 5. In this way, the amount of air flowing through the vicinity of both ends of each of the slits 4 and 5 can be made far smaller than the amount of airflow in the center thereof, so that the amount of air flowing through the vicinity of both ends of developing roller 3*a* and the cleaning blade 7*a* can be made far smaller than the amount of airflow in the center thereof.

Figure 5:
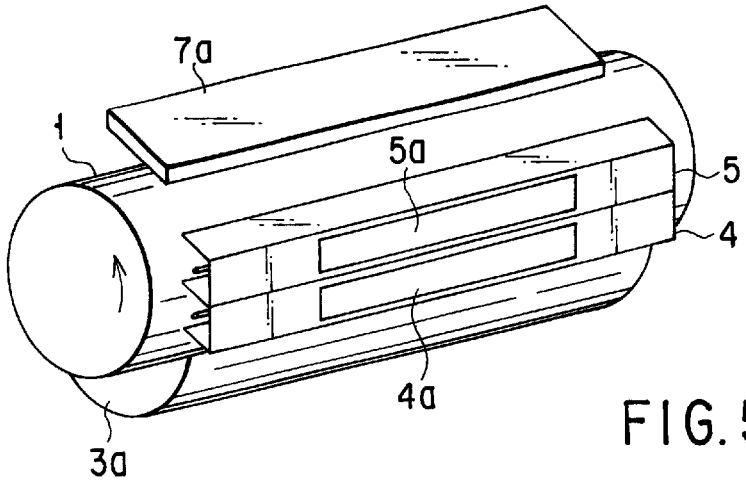
FIG. 5 is a perspective view illustrating the structure of a fourth embodiment of the present invention.

FIG. 5 illustrates a fourth embodiment. In this embodiment, both ends of a slit 4*a* of a transfer charger 4 and both ends of a slit 5*a* of a separation charger 5 are made short. In other words, the length of each of the slits 4*a* and 5*a* is made shorter than the length of each of cases 4*b* and 5*b* so that no opened area is formed near both ends of each of the cases. In this way, no air flows through the vicinity of both ends of each of slits 4*a* and 5*a*, so that the amount of air flowing through the vicinity of both ends of developing roller 3*a* and the cleaning blade 7*a* can be made about zero.

Figure 6:
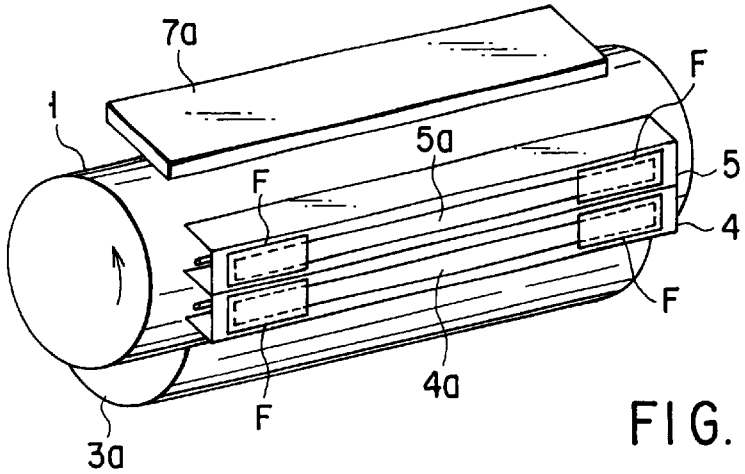
FIG. 6 is a perspective view illustrating the structure of a fifth embodiment of the present invention.

FIG. 6 illustrates a fifth embodiment. In this embodiment, slits 4*a* and 5*a* are formed over the roughly full length of cases 4*b* and 5*b* of chargers 4 and 5, respectively, and then films F are attached thereto in order to block up the vicinity of both ends of each of the slits. As the film F, for example, a Mylar sheet having insulation can be used. In this way, no air flows through the vicinity of both ends of each of slits 4*a* and 5*a*, so that the amount of air flowing through the vicinity of both ends of developing roller 3*a* and the cleaning blade 7*a* can be made about zero, as is in the fourth embodiment.

In the cases 4*b* and 5*b* of the chargers 4 and 5, no electric current passes through the portions in which the openings are made. An electric current flowing in the photosensitive drum 1 becomes larger for that. In other words, when the shapes of the slits 4*a* and 5*b*, that is, the openings are made different along their longitudinal direction as described in the first to fourth embodiments, the amount of the electric current flowing in the photosensitive drum 1 becomes uneven along the longitudinal direction of the respective chargers 4 and 5. As a result, transfer failure or separation failure may be caused. For this reason, in the fifth embodiment, the shape of the slits 4*a* and 5*a* is made even over the full length of the cases 4*b* and 5*b*, and then the films F are attached to the vicinity of both ends of each thereof.

In the first to fifth embodiments, the slits 4*a* and 5*a* are made in the case 4*b* of the transfer charger 4 and the case 5*b* of the separation charger 5, respectively. However, a slit may be made in at least one of the cases. About the shape of the slits 4*a* and 5*a,* it is sufficient that the opened area near each end thereof in the longitudinal direction is smaller than the opened area in the center portion. Thus, the shape is not limited to the shape in each of the embodiments.

Figure 7:
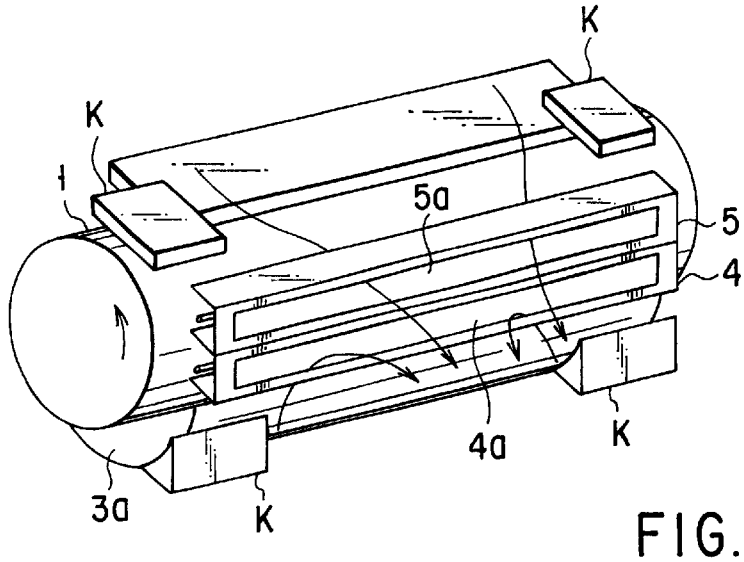
FIG. 7 is a perspective view illustrating the structure of a sixth embodiment of the present invention.

FIG. 7 illustrates a sixth embodiment. In this embodiment, cover members K (regulating members) in a block form are arranged near both ends in the axial direction of a developing roller 3*a* and both ends in the longitudinal direction of a cleaning blade 7*a*. The cover members K for the developing roller 3*a* are set up closely to the developing roller 3*a,* at the side where the end of the developing roller 3*a* is opposite to the feed path 11, in the manner that airflow generated by the fan 14 does not pass through the ends of the developing roller 3*a*. The cover members K function to block up the gap between the outer peripheral surface 1*a* of the photosensitive drum 1 and the ends of developing roller 3*a*. Similarly, the cover members K arranged near both ends of the cleaning blade 7*a* function to block up the gap between the outer peripheral surface 1*a* of the photosensitive drum 1 and the ends of cleaning blade 7*a*. In this case, for example, by forming the respective slits 4*a* and 5*a* into the same as in the fourth embodiment and making about zero the amount of airflow flowing through both ends of the developing roller 3*a* and the cleaning blade 7*a,* the scattered amount of the toner can be more effectively reduced. The shape of the slits 4*a* and 5*a* is not limited to the illustrated shape.

Figure 8:
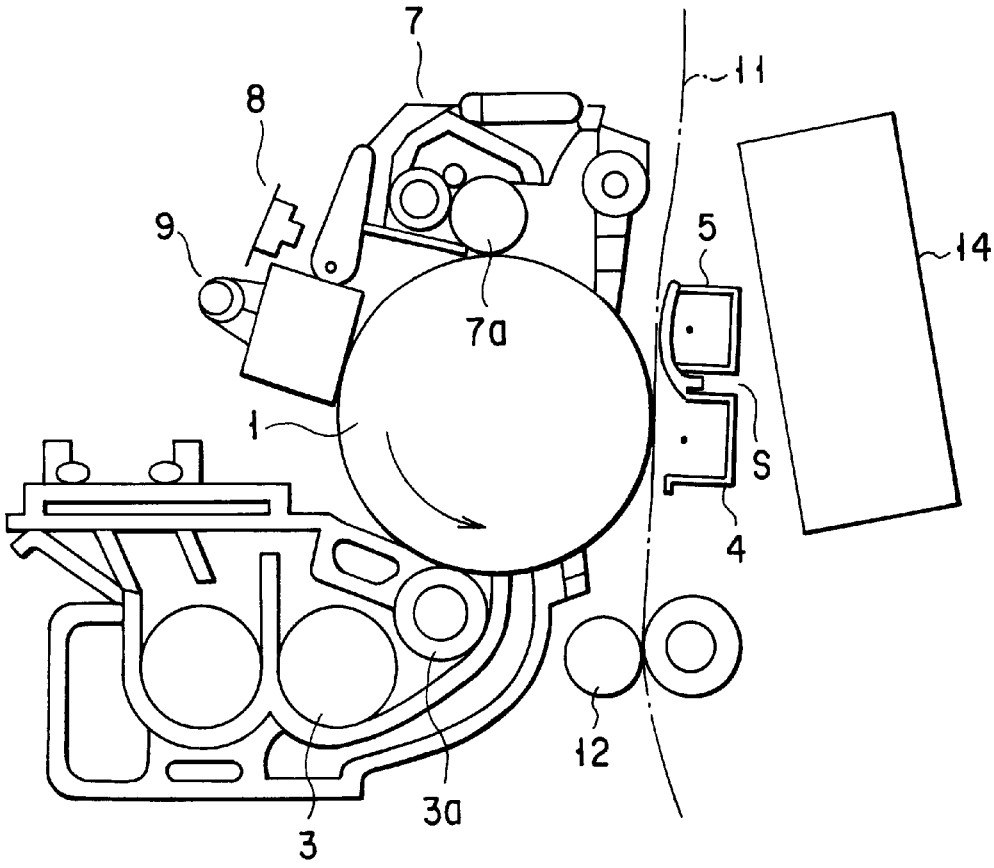
FIG. 8 is a schematic view illustrating the structure of main members of an image forming apparatus including a seventh embodiment of the present invention.
Figure 9:
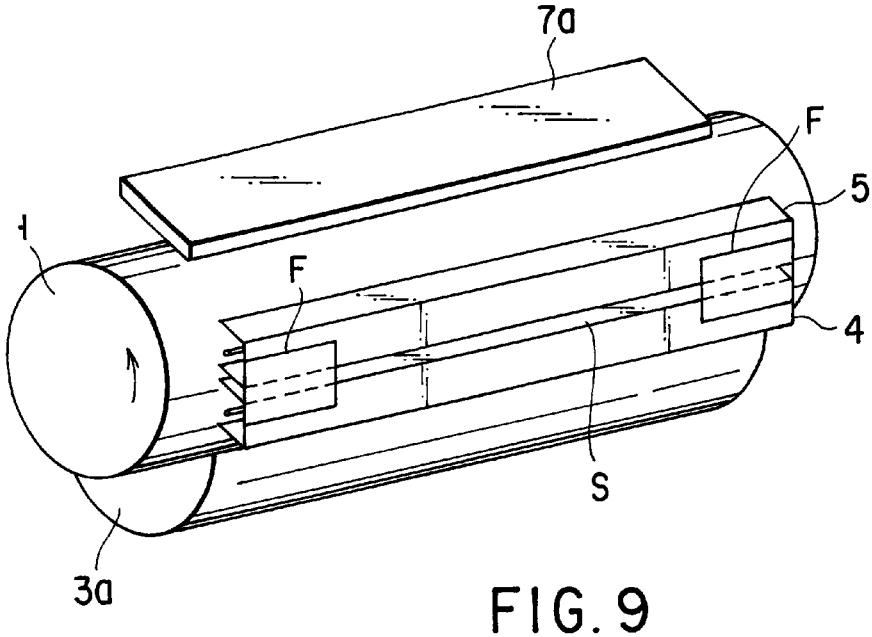
FIG. 9 is a perspective view illustrating the structure of the seventh embodiment of the present invention.

FIG. 9 illustrates a seventh embodiment. FIG. 8 schematically illustrates the structure of main members of an MPF including the structure illustrated in FIG. 9. To members functioning in the same way as in the above-mentioned embodiments, the same reference numbers are attached. Detailed explanation thereof is omitted.

In this embodiment, no slit is made in the bottom of the case 4*b* of the transfer charger 4 and the bottom of the case 5*b* of the separation charger 5, and a gap S is made between the charger 4 and the charger 5, so that air is sucked from the gap S. In this case, negative pressure is generated at the side, facing the feed path 11, of the gap S. In this way, no air passes in the cases 4*b* and 5*b* of the chargers 4 and 5, as is in the first to sixth embodiments. Thus, no toner adheres to the inside of the cases 4*b* and 5*b*. As a result, it is possible to prevent transfer failure and separation failure based on toner-adhesion, and prevent malfunction of the MPF based on leakage.

On the other hand, the following method may be suggested: air is sucked from the upper side (the downstream side) of the separation charger 5 without the formation of the gap S between the chargers 4 and 5. However, if air is sucked from this position, the distance between the position and the outer peripheral surface 1*a* of the photosensitive drum 1 becomes relatively large. It is therefore difficult that airflow from the fan 14 acts on paper. In this case, it is advisable that the fan 14 is made large-sized to increase the amount of air flowing in the apparatus. However, if the amount of air is increased, the amount of toner that is desirably sucked from both ends of the developing roller 3*a* and the both ends of the cleaning blade 7*a* increases. As a result, the amount of the toner scattered inside the apparatus increases and the amount of the toner discharged out of the apparatus also increases. Thus, various problems are caused. For example, it becomes necessary to set up a filter in an air outlet of the fan 14.

In the case of sucking air as is in the present embodiment, it is necessary not to cause air to flow through both ends of the developing roller 3*a* and the cleaning blade 7*a,* as is in the first to sixth embodiments. Films F are attached to the back sides of the cases 4*b* and 5*b* of the charges 4 and 5 to block up the vicinity of both ends of the gap S between the chargers 4 and 5. Cover members K as in the sixth embodiment may be arranged.

Figure 10:
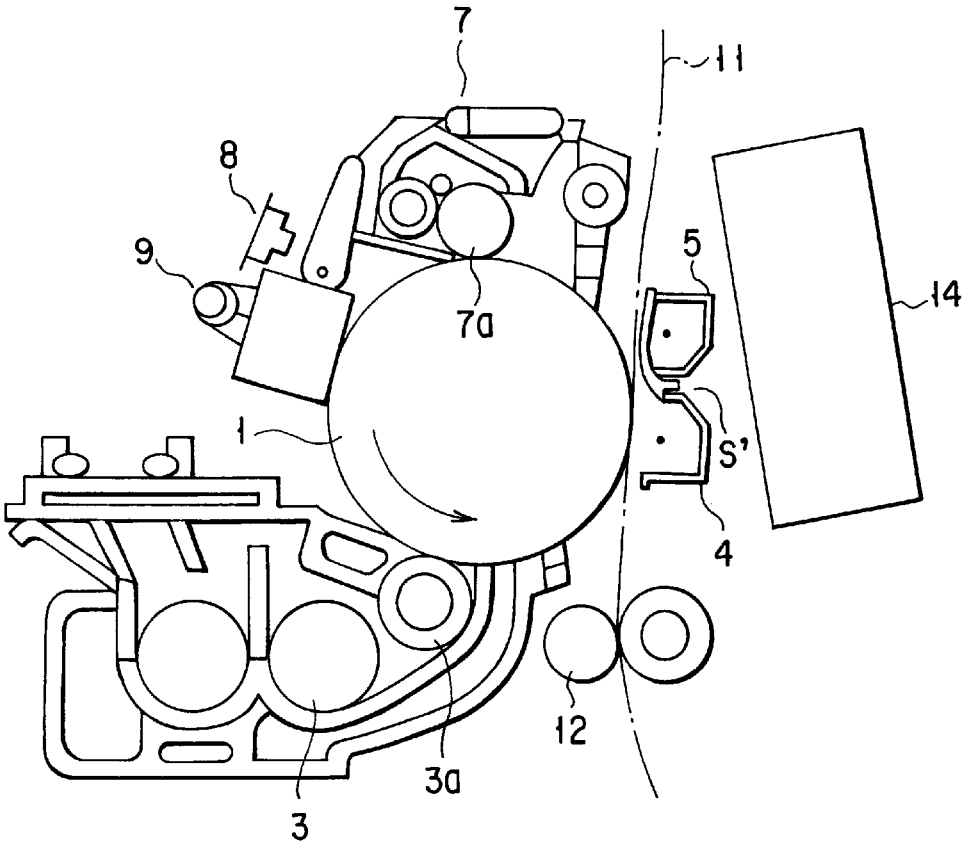
FIG. 10 is a schematic view illustrating the structure of main members of an image forming apparatus including an eighth embodiment of the present invention.
Figure 11:
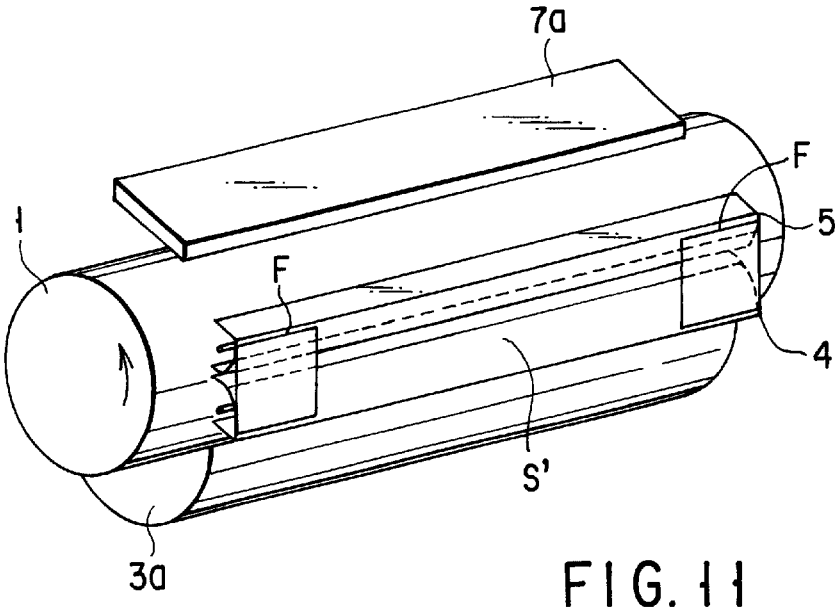
FIG. 11 is a perspective view illustrating the structure of the eighth embodiment of the present invention.

FIG. 11 illustrates an eight embodiment. FIG. 10 schematically illustrates the structure of main members of an MPF including the structure illustrated in FIG. 11. As is in the seventh embodiment, a gap S' is made between the charger 4 and the charger 5, so that air is sucked from the gap S'. This gap S' is made to become wider toward the back side of the cases 4*b* and 5*b*. In this way, the efficiency of sucking air by the fan 14 can be made higher than the above-mentioned seventh embodiment.

As described above, according to the present invention, in a vertical feed type image forming apparatus, wherein a transfer material is fed in the vertical direction and passed through its transfer area, negative pressure is caused to act on a transfer material that has passed through the transfer area so that the feed pose thereof can be made stable. Moreover, it is possible to reduce the amount of scattering, in the apparatus, of toner carried on airflow from a fan for generating the negative pressure. It is also possible to prevent a transfer charger and a separation charger present on the path of the airflow from being polluted with the toner and prevent a great deal of the toner from being discharged out of the apparatus.

The present invention is not limited to the above-mentioned embodiments, and can be modified to variations within the scope of the present invention. For example, the above-mentioned embodiments are concerned with vertical feed type MPFs, wherein a transfer material is fed in the vertical direction and is passed in their transfer area. The present invention can be however applied to horizontal feed type apparatuses, wherein a transfer material is fed in the substantially horizontal direction and is passed in their transfer area.

What is claimed is:

1. An image forming apparatus comprising:

a developing device to supply a developer to a latent image formed onto an image carrying body to form a developer image on the image carrying body;

a feeding device to feed a transfer material;

a transferring device to transfer the developer image onto the transfer material fed by the feeding device;

an airflow forming device to form flow of air for stabilizing feed pose of the transfer material that has passed through a transfer area between the transferring device and the image carrying body; and a regulating member to regulate a part of the airflow formed by the airflow device so as to reduce a scattered amount of the developer.

2. The image forming apparatus according to claim 1, wherein the feed path extends in a substantially vertical direction.

3. The image forming apparatus according to claim 2, wherein the airflow forming device comprises a fan for sucking air from the side of the feed path opposite to the image carrying body.

4. The image forming apparatus according to claim 1, wherein the developing device comprises a developing roller for supplying the developer onto the image carrying body by rotation, and the regulating member regulates a part of air flowing through the vicinity of both ends in the axial direction of the developing roller.

5. The image forming apparatus according to claim 4, wherein the feed path extends in a substantially vertical direction.

6. The image forming apparatus according to claim 5, wherein the airflow forming device comprises a fan for sucking air from the side of the feed path opposite to the image carrying body.

7. An image forming apparatus comprising:

a developing device to supply a developer to a latent image formed onto an image carrying body to form a developer image on the image carrying body;

a feeding device to feed a transfer material;

a transferring device to transfer the developer image onto the transfer material fed by the feeding device;

an airflow forming device to form flow of air for stabilizing feed pose of the transfer material that has passed through a transfer area between the transferring device and the image carrying body; and a regulating member to regulate a part of the airflow formed by the airflow device so as to reduce a scattered amount of the developer, wherein the developing device comprises a developing roller for supplying the developer onto the image carrying body by rotation, wherein the regulating member regulates a part of air flowing through the vicinity of both ends in the axial direction of the developing roller, wherein the feed path extends in a substantially vertical direction, wherein the airflow forming device comprises a fan for sucking air from the side of the feed path opposite to the image carrying body, and wherein the regulating member comprises a slit, through which air passes, extended in the axial direction of the developing roller between the fan and the feed path, and the amount of flow of air is reduced by making opened areas of both ends in the longitudinal direction of the slit small.

8. An image forming apparatus comprising:

a developing device to supply a developer to a latent image formed onto an image carrying body to form a developer image on the image carrying body;

a feeding device to feed a transfer material;

a transferring device to transfer the developer image onto the transfer material fed by the feeding device;

an airflow forming device to form flow of air for stabilizing feed pose of the transfer material that has passed through a transfer area between the transferring device and the image carrying body; and a regulating member to regulate a part of the airflow formed by the airflow device so as to reduce a scattered amount of the developer, wherein the developing device comprises a developing roller for supplying the developer onto the image carrying body by rotation, wherein the regulating member regulates a part of air flowing through the vicinity of both ends in the axial direction of the developing roller, wherein the feed path extends in a substantially vertical direction, wherein the airflow forming device comprises a fan for sucking air from the side of the feed path opposite to the image carrying body, and wherein the regulating member comprises a covering member for covering at least the vicinity of both ends of the developing roller.

9. An image forming apparatus comprising:

a developing device comprising a developing roller that opposes an image carrying body, to cause the developing roller to be rotated so as to supply a developer to a latent image formed onto the image carrying body, thereby forming a developer image on the image carrying body;

a feeding device to feed a transfer material, using a feed path extending along the image carrying body;

a transferring device to transfer the developer image onto the transfer material fed using the feed path;

a separation device to separate, from the image carrying body, the transfer material on which the developed image is transferred;

an airflow forming device to suck air from the side, opposite to the image carrying body, of the feed path to form flow of air advancing from the image carrying body to the transferring device and the separation device, to absorb the transfer material passing through a transfer area between the transferring device and the image carrying body, thereby stabilizing feed pose of the transfer material;

a cleaning device to clean the developer remaining on the image carrying body without being transferred by the transferring device; and a regulating member to regulate a part of the airflow formed by the airflow forming device so as to reduce a scattered amount of the developer.

10. The image forming apparatus according to claim 9, wherein the feed path extends in a substantially vertical direction.

11. The image forming apparatus according to claim 10, wherein the airflow forming device comprises a fan for sucking air from the back side of the transferring device and the separation device.

12. The image forming apparatus according to claim 9, wherein the regulating member regulates a part of air flowing through the vicinity of both ends in the axial direction of the developing roller and the cleaning device.

13. The image forming apparatus according to claim 12, wherein the feed path extends in a substantially vertical direction.

14. The image forming apparatus according to claim 13, wherein the airflow forming device comprises a fan for sucking air from the back side of the transferring device and the separation device.

15. An image forming apparatus comprising:

a developing device comprising a developing roller that opposes an image carrying body, to cause the developing roller to be rotated so as to supply a developer to a latent image formed onto the image carrying body, thereby forming a developer image on the image carrying body;

a feeding device to feed a transfer material, using a feed path extending along the image carrying body;

a transferring device to transfer the developer image onto the transfer material fed using the feed path;

a separation device to separate, from the image carrying body, the transfer material on which the developed image is transferred;

an airflow forming device to suck air from the side, opposite to the image carrying body, of the feed path to form flow of air advancing from the image carrying body to the transferring device and the separation device, to adsorb the transfer material passing through a transfer area between the transferring device and the image carrying body, thereby stabilizing feed pose of the transfer material;

a cleaning device to clean the developer remaining on the image carrying body without being transferred by the transferring device; and a regulating member to regulate a part of the airflow formed by the airflow forming device so as to reduce a scattered amount of the developer, wherein the regulating member regulates a part of air flowing through the vicinity of both ends in the axial direction of the developing roller and the cleaning device, wherein the feed path extends in a substantially vertical direction, wherein the airflow forming device comprises a fan for sucking air from the back side of the transferring device and the separation device, and wherein the regulating member comprises a slit, through which air passes, extended in the axial direction of the developing roller and the cleaning device between the fan and the feed path, and the amount of flow of air is reduced by making opened areas of both ends in the longitudinal direction of the slit small.

16. An image forming apparatus comprising:

a developing device comprising a developing roller that opposes an image carrying body, to cause the developing roller to be rotated so as to supply a developer to a latent image formed onto the image carrying body, thereby forming a developer image on the image carrying body;

a feeding device to feed a transfer material, using a feed path extending along the image carrying body;

a transferring device to transfer the developer image onto the transfer material fed using the feed path;

a separation device to separate, from the image carrying body, the transfer material on which the developed image is transferred;

an airflow forming device to suck air from the side, opposite to the image carrying body, of the feed path to form flow of air advancing from the image carrying body to the transferring device and the separation device, to adsorb the transfer material passing through a transfer area between the transferring device and the image carrying body, thereby stabilizing feed pose of the transfer material;

a cleaning device to clean the developer remaining on the image carrying body without being transferred by the transferring device; and a regulating member to regulate a part of the airflow formed by the airflow forming device so as to reduce a scattered amount of the developer, wherein the regulating member regulates a part of air flowing through the vicinity of both ends in the axial direction of the developing roller and the cleaning device, wherein the feed path extends in a substantially vertical direction, wherein the airflow forming device comprises a fan for sucking air from the back side of the transferring device and the separation device, and wherein the regulating member comprises a covering member for covering at least the vicinity of both ends of the developing roller and the cleaning device.

17. An image forming process comprising the steps of:

rotating a developing roller that opposes an image carrying body to supply a developer to a latent image formed onto the image carrying body, thereby developing the latent image;

feeding a transfer material to the developer image developed on the image carrying body;

transferring the developer image onto the fed transfer material;

forming flow of air for stabilizing feed pose of the transfer material on which the developer image is transferred; and regulating a part of the airflow to reduce a scattered amount of the developer.

18. The image forming process apparatus according to claim 17, wherein the transfer material is fed in a substantially vertical direction to be sent to the developer image.

19. An image forming process comprising the steps rotating a developing roller that opposes an image carrying body to supply a developer to a latent image formed onto the image carrying body, thereby developing the latent image;

feeding a transfer material to the developer image developed on the image carrying body;

transferring the developer image onto the fed transfer material;

forming flow of air for stabilizing feed pose of the transfer material on which the developer image is transferred; and regulating a part of air passing through the vicinity of both ends in the axial direction of the developing roller, among the above-mentioned airflow, to reduce a scattered amount of the developer.

20. An image forming apparatus comprising:

a developing device comprising a developing roller that opposes an image carrying body, to cause the developing roller to be rotated so as to supply a developer to a latent image formed onto the image carrying body, thereby forming a developer image on the image carrying body;

a feeding device to feed a transfer material, using a feed path extending along the image carrying body;

a transferring device to transfer the developer image onto the transfer material fed using the feed path;

a separation device to separate, from the image carrying body, the transfer material on which the developed image is transferred;

an airflow forming device to suck air from the side, opposite to the image carrying body, of the feed path to form flow of air advancing from the image carrying body to the transferring device and the separation device, to adsorb the transfer material passing through a transfer area between the transferring device and the image carrying body, thereby stabilizing feed pose of the transfer material;

a cleaning device to clean the developer remaining on the image carrying body without being transferred by the transferring device; and a regulating member to regulate a part of the airflow formed by the airflow forming device so as to reduce a scattered amount of the developer, wherein the airflow forming device suctions air from rear sides of the transfer device and separation device via a gap between the transfer device and the separation device.

21. The image forming apparatus according to claim 20, wherein the regulating member has a film for covering vicinities of both longitudinal-direction ends of the gap.

22. The image forming apparatus according to claim 20, wherein the gap is formed such as to expand towards the rear sides of the transfer device and the separation device.

23. The image forming apparatus according to claim 22, wherein the regulating member has a film for covering vicinities of both longitudinal-direction ends of the gap.

24. An image forming apparatus comprising:

a developing device to supply a developer to a latent image onto an image carrying body to form a developer image on the image supplying body, said developing device being elongated along the image carrying body;

a feeding device to feed a transfer material;

a transferring device to transfer the developer image onto the transfer material fed by the feeding device;

an airflow forming device to form flow of air for stabilizing feed pose of the transfer material that has passed through a transfer area between the transferring device and the image carrying body; and a regulating member to regulate a part of air passing through the vicinity of both ends in a longitudinal direction of the developing device among the airflow.

* * * * *